US011421473B2

(12) United States Patent
Campagna et al.

(10) Patent No.: US 11,421,473 B2
(45) **Date of Patent: *Aug. 23, 2022**

(54) ARCHITECTURAL ROLLER SHADE HOUSING WITH ADJUSTABLE BATTERY COMPARTMENT

(71) Applicant: Crestron Electronics, Inc., Rockleigh, NJ (US)

(72) Inventors: Michael Campagna, Woodcliff Lake, NJ (US); Stan Wisniewski, Pompton Plains, NJ (US); Bruce Ryan Dahlgren, Buford, GA (US)

(73) Assignee: Crestron Electronics, Inc., Rockleigh, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/224,371

(22) Filed: Apr. 7, 2021

(65) Prior Publication Data

US 2021/0222490 A1 Jul. 22, 2021

Related U.S. Application Data

(63) Continuation-in-part of application No. 16/250,164, filed on Jan. 17, 2019, now Pat. No. 11,002,071.

(60) Provisional application No. 62/649,638, filed on Mar. 29, 2018.

(51) Int. Cl.
*E06B 9/42* (2006.01)
*E06B 9/72* (2006.01)

(52) U.S. Cl.
CPC . *E06B 9/42* (2013.01); *E06B 9/72* (2013.01)

(58) Field of Classification Search
CPC ..... E06B 9/72; E06B 9/42
USPC ..... 160/310
See application file for complete search history.

(56) References Cited

U.S. PATENT DOCUMENTS

| | | | | |
|---|---|---|---|---|
| 6,382,294 | B1 * | 5/2002 | Anderson | E06B 9/323 429/100 |
| 8,820,386 | B2 * | 9/2014 | Mullet | E06B 9/40 160/241 |
| 9,115,537 | B2 * | 8/2015 | Blair | E06B 9/68 |
| 10,094,169 | B2 * | 10/2018 | Kirby | E06B 9/42 |
| 11,002,071 | B2 * | 5/2021 | Campagna | E06B 9/42 |
| 2003/0168187 | A1 * | 9/2003 | Wen | E06B 9/32 160/168.1 P |
| 2012/0090797 | A1 * | 4/2012 | Mullet | E06B 9/322 160/331 |

(Continued)

*Primary Examiner* — Beth A Stephan
(74) *Attorney, Agent, or Firm* — Crestron Electronics, Inc.

(57) ABSTRACT

Battery operated shade comprising a shade material operably connected at its top end to a motor drive unit that raises and lowers the shade material between an upper limit and a lower limit to adjustably cover a structural opening. The shade comprises a housing that at least partially conceals the motor drive unit. The shade further comprises a battery compartment for providing power to the motor drive unit and a pair of swing arms each pivotally connected at their proximal end to the shade housing and at their distal end to the battery compartment. The pair of swing arm are adapted to pivot with respect to the shade housing to swivel the battery compartment from a first position, where the battery compartment is at least partially concealed by the shade housing and the pair of swing arms are retained by a pair of retaining clips, to a second position where the battery compartment extends out of the shade housing.

20 Claims, 10 Drawing Sheets

(56) References Cited

U.S. PATENT DOCUMENTS

| | | | | |
|---|---|---|---|---|
| 2013/0098561 | A1* | 4/2013 | Mullet | E06B 9/50 160/39 |
| 2013/0153162 | A1* | 6/2013 | Blair | E06B 9/266 160/310 |
| 2014/0231032 | A1* | 8/2014 | Blair | E06B 9/68 160/310 |
| 2014/0305602 | A1* | 10/2014 | Kirby | E06B 9/70 160/310 |
| 2015/0247362 | A1* | 9/2015 | Kirby | E06B 9/68 160/310 |

* cited by examiner

ARCHITECTURAL ROLLER SHADE HOUSING WITH ADJUSTABLE BATTERY COMPARTMENT

BACKGROUND OF THE INVENTION

Technical Field

Aspects of the embodiments generally relate to battery operated roller shades, and more particularly to an architectural roller shade housing with adjustable battery compartment.

Background Art

Motorized roller shades provide a convenient one-touch control solution for screening windows, doors, or the like, to achieve privacy and thermal effects. A motorized roller shade typically includes a rectangular shade material attached at one end to a cylindrical rotating tube, called a roller tube, and at an opposite end to a hem bar. The shade material is wrapped around the roller tube. An electric motor, either mounted inside the roller tube or externally coupled to the roller tube, rotates the roller tube to unravel the shade material to cover a window.

Motorized roller shades require local power to be provided to the shade to energize the motor and associated electronics, such as the radio, control circuitry, and encoders, among other devices. Power is typically supplied using power over Ethernet (PoE) wiring, or a local power supply, such as a 24V wall-wart, which may be unsightly and/or challenging to install. In many installations, it may be difficult or impossible to run power and communication wires to a specific location especially in retrofit applications. Battery powered roller shades with radio transceivers for communication provide means to easily install and control a roller shade without running new wires. To enable operation of a roller shade for a prolonged amount of time, many large batteries are required, which present a challenge since they are needed to be stored in proximity to the roller tube in a hidden position. Roller shades typically house the batteries inside the roller tube or roller shade housing out of site from the end user. However, battery replacement in such roller shades is a cumbersome and difficult exercise.

Therefore, a need has arisen for systems, methods, and modes for an improved architectural roller shade housing with adjustable battery compartment that is easily accessible by the user.

SUMMARY OF THE INVENTION

It is an object of the embodiments to substantially solve at least the problems and/or disadvantages discussed above, and to provide at least one or more of the advantages described below.

It is therefore a general aspect of the embodiments to provide systems, methods, and modes for a battery operated roller shade that will obviate or minimize problems of the type previously described.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

Disclosure of Invention

According to one aspect of the present embodiments, a battery operated shade is provided for adjustably cover a structural opening. The battery operated shade comprises a shade material extending from a top end to a bottom end and a motor drive unit operably connected to the top end of the shade material to raise and lower the shade material between an upper limit and a lower limit to adjustably cover and uncover the structural opening. The battery operated shade also comprises a shade housing adapted to at least partially conceal the motor drive unit, wherein the shade housing comprises an opening from which the shade material exits the shade housing. The battery operated shade further comprises a battery compartment adapted to removably retain batteries for providing power to the motor drive unit and a pair of swing arms each comprising a proximal end pivotally connected to the shade housing and a distal end connected to the battery compartment; wherein the pair of swing arms are adapted to pivot with respect to the shade housing to swivel the battery compartment from a first position, where the battery compartment is at least partially concealed by the shade housing and the pair of swing arms are retained within the shade housing by a pair of retaining clips, to a second position, where the battery compartment extends out of the shade housing.

According to another embodiment, each retaining clip comprises a pair of oppositely disposed spring arms biased toward each other, wherein the proximal end of each swing arm is retained between the spring arms of the respective retaining clip when the battery compartment is in the first position. The spring arms of each retaining clip may comprise bulges inwardly extending toward each other and wherein the proximate ends of each swing arm comprise grooves shaped and sized to receive the bulges therein to maintain the battery compartment in the first position. The battery operated shade may further comprise a pair of support brackets each comprising one of the pair of swing arms, wherein the pair of support bracket connect the pair of swing arms to the shade housing.

According to another embodiment, the battery operated shade further comprises a connector bracket pivotally connected to the shade housing, wherein the connector bracket is adapted to swivel with respect to the shade housing from a first position where the connector bracket is at least partially concealed by the shade housing to a second position where the connector bracket is at least partially extends out of the shade housing, wherein the connector bracket comprises a port retaining portion adapted to retain a port for electrically connecting the battery compartment to the motor drive unit, wherein the connector bracket is retained within the shade housing by a third retaining clip when the connector bracket is in the first position. The third retaining clip may comprise a pair of oppositely disposed spring arms biased toward each other, wherein the connector bracket comprises a clip engaging portion adapted to be retained between the spring arms of the third retaining clip. The spring arms of the third retaining clip may comprise bulges inwardly extending toward each other and wherein the clip engaging portion comprises grooves shaped and sized to receive the bulges therein to maintain the connector bracket in the first position.

According to an embodiment, the battery compartment is slidably connected to the pair of swing arms such that it slides with respect to the swing arms between their distal end and proximal end. Each swing arm may comprise a longitudinal channel extending from about its proximal end to about its distal end, wherein the battery compartment comprises nipples in each of its ends adapted to slide within the longitudinal channel in each swing arm. When the swing arms and thereby the battery compartment are in the first position, the battery compartment is positioned proximate to the proximal ends of the swing arms, and wherein when the swing arms and thereby the battery compartment are in the second position, the battery compartment is positioned proximate to the distal ends of the swing arms.

According to an embodiment, the battery compartment extends out of the shade housing through the opening in the shade housing. The battery compartment may be attached to the shade housing below the motor drive unit, wherein the opening in the shade housing is located below the battery compartment. The shade housing may comprise a front wall connected to a bottom wall that defines the opening.

According to an embodiment, the battery compartment may comprise a battery opening that traversely extends through a side surface of the battery compartment. The battery compartment may comprises a door adapted to translate from a closed position where it closes the battery opening to an opened position where it exposes the battery opening. The door may comprises a latch adapted to removably fasten to a mating groove disposed on the battery compartment to maintain the door in a closed position.

According to an embodiment, the motor drive unit is adapted to determine whether power of the batteries in the battery compartment is below a minimum battery threshold and when determining that the battery power is below the minimum battery threshold to move the shade material to a battery replacement position. The battery replacement position may comprise a position where the bottom end of the shade material is positioned at a predetermined distance from the upper limit. The minimum battery threshold may correspond to the battery power required to raise the shade material from the lower limit to the battery replacement position. After moving the shade material to the battery replacement position, the motor drive unit may disable movement of the shade material until the batteries are replaced.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

BRIEF DESCRIPTION OF THE SEVERAL VIEWS OF THE DRAWINGS

Figure 1:
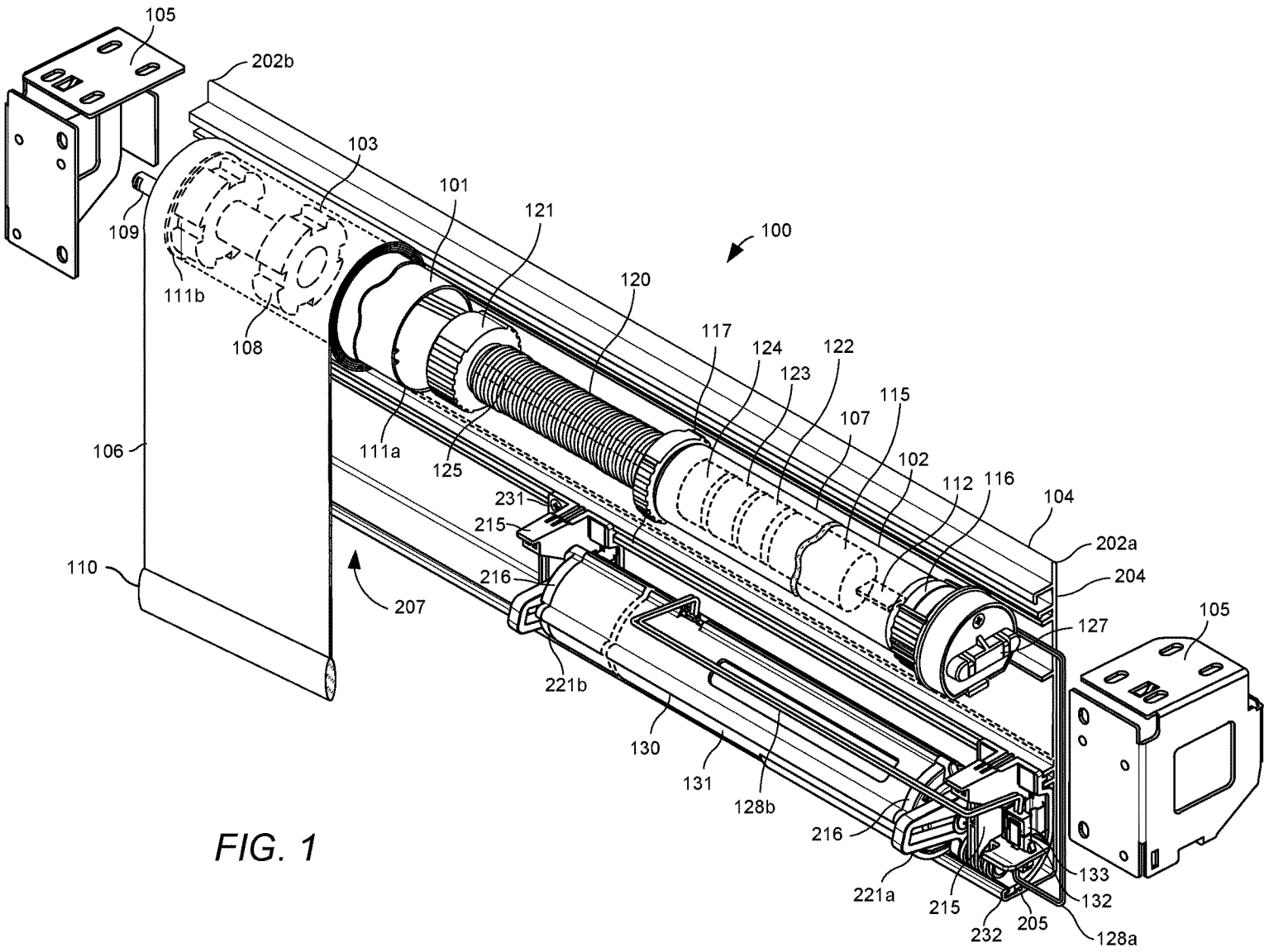

FIG. 1 illustrates a rear perspective view of a battery operated shade according to an illustrative embodiment.

Figure 2:
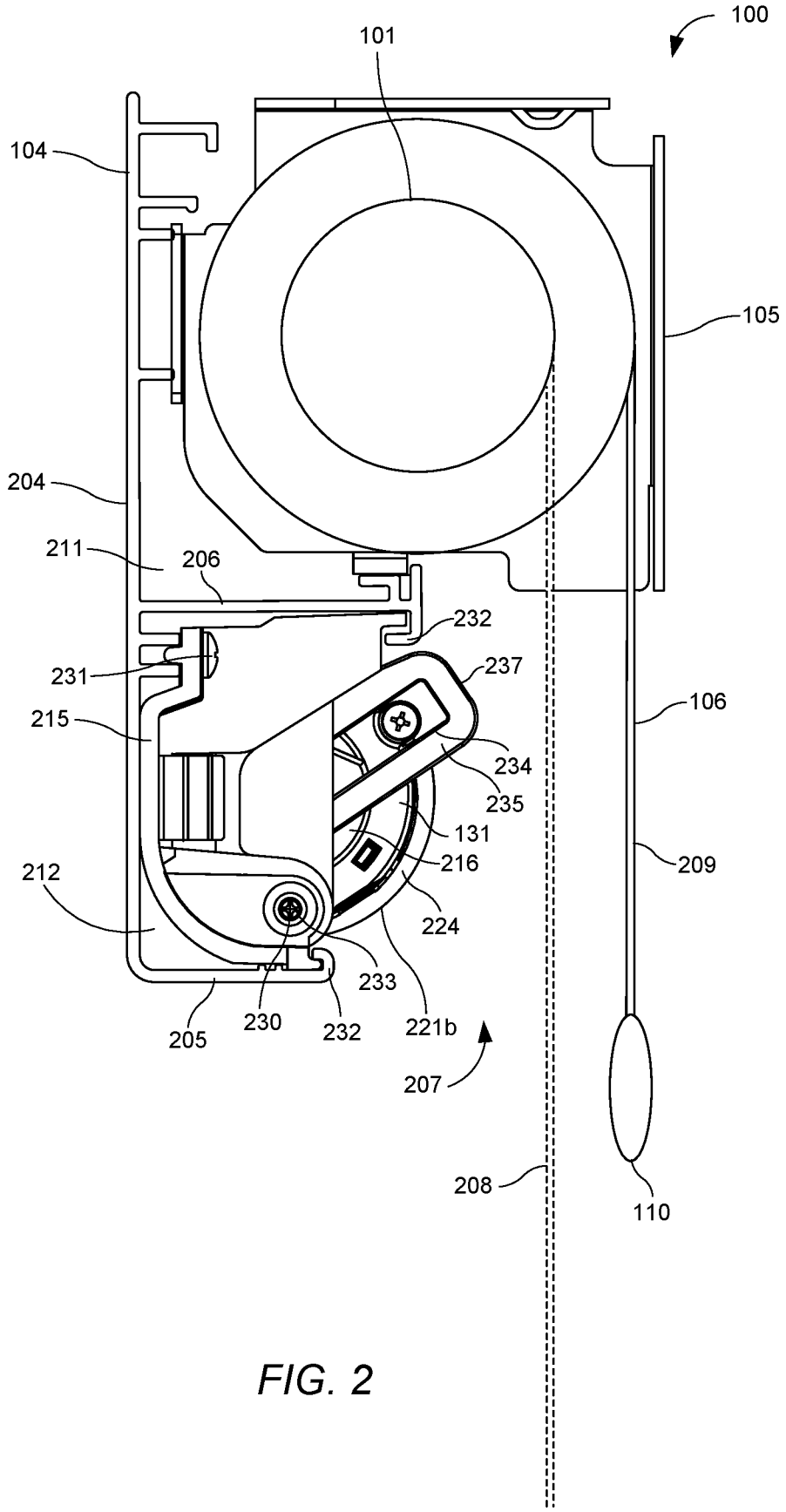

FIG. 2 illustrates a side view of the battery operated roller shade with a battery compartment in a retracted and hidden position within the roller shade housing according to an illustrative embodiment.

Figure 3:
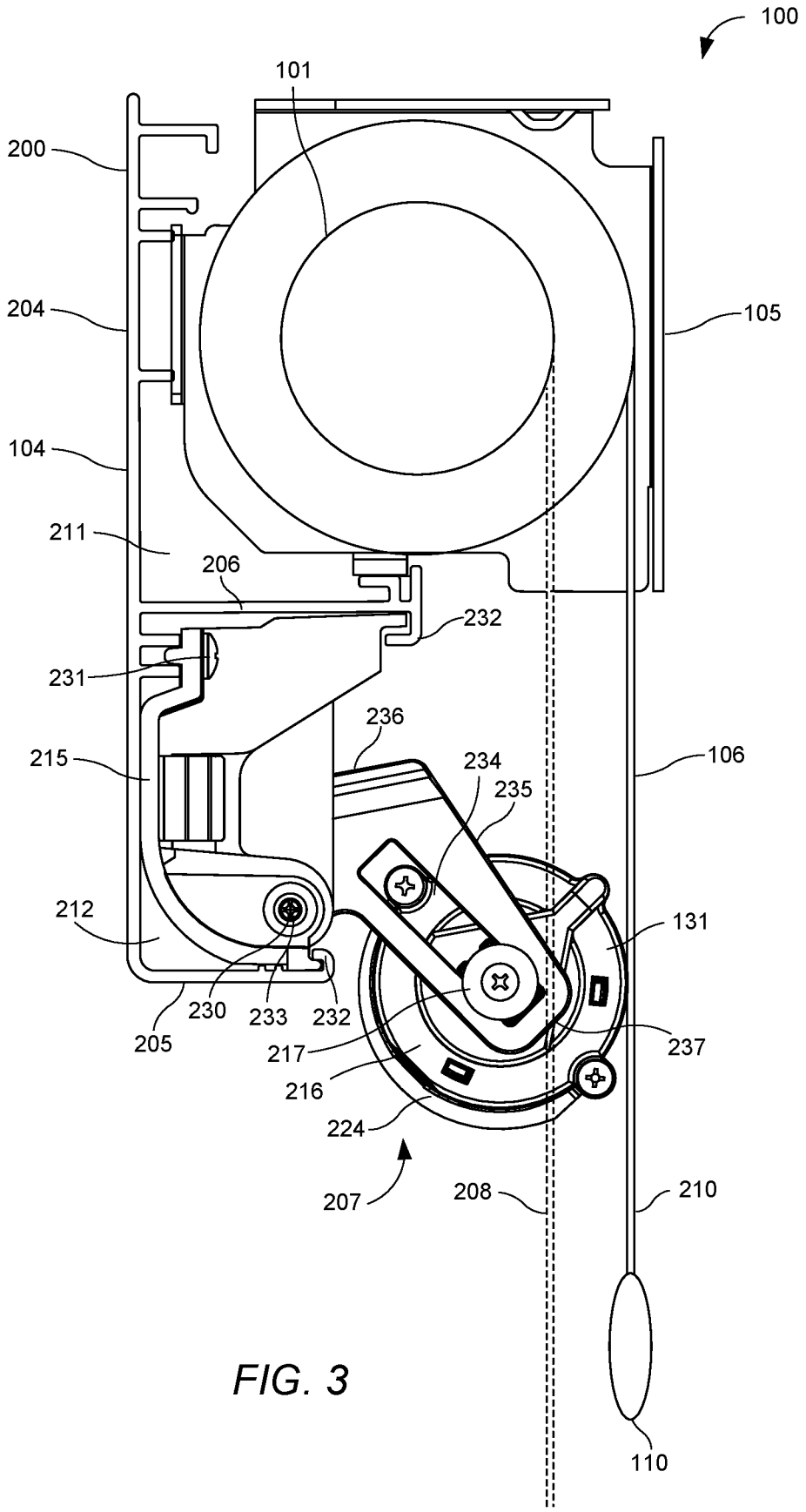

FIG. 3 illustrates a side view of the roller shade with the battery compartment in a partially extended position with respect to the roller shade housing according to an illustrative embodiment.

Figure 4:
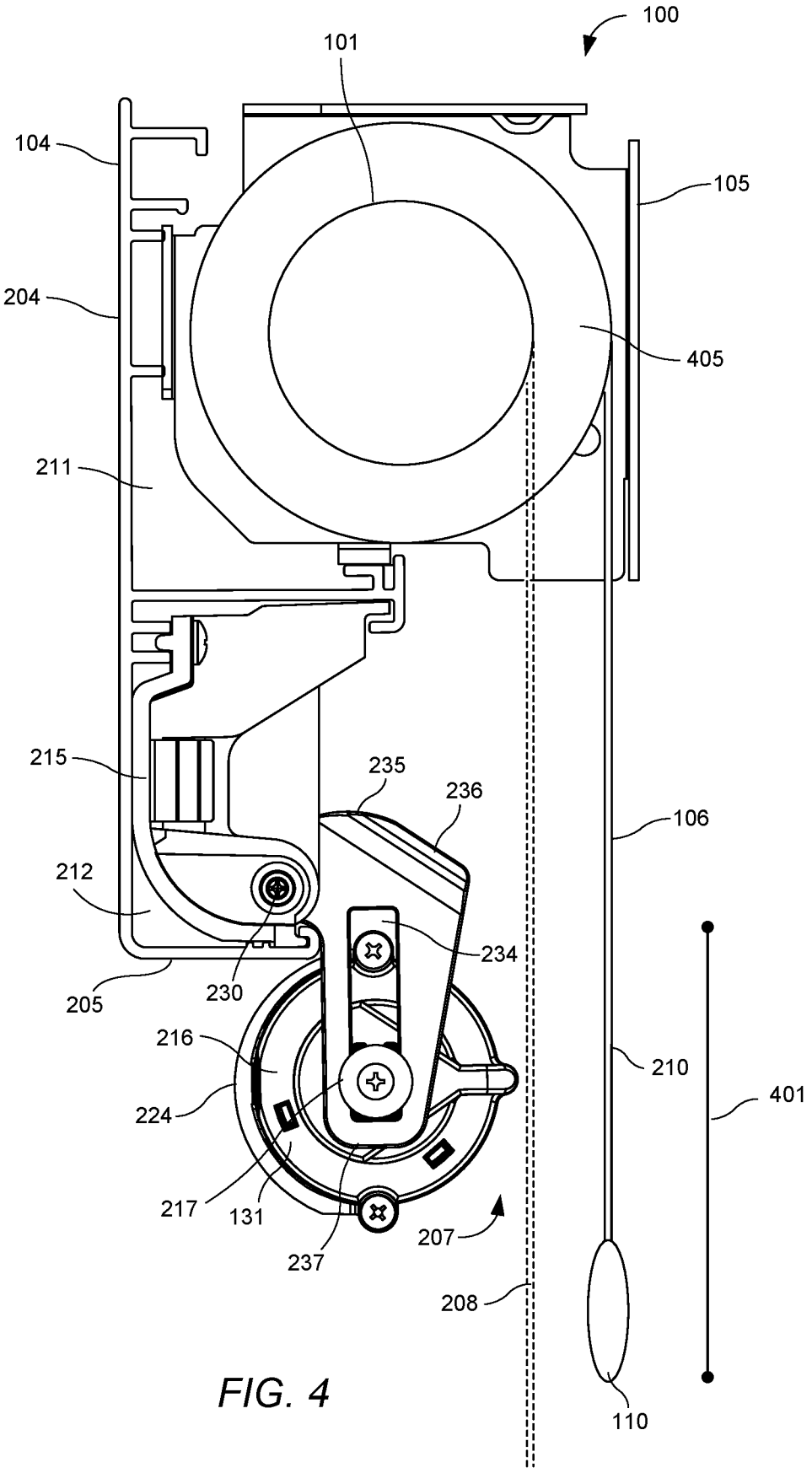

FIG. 4 illustrates a side view of the roller shade with the battery compartment in a fully extended position with respect to the roller shade housing according to an illustrative embodiment.

Figure 5:
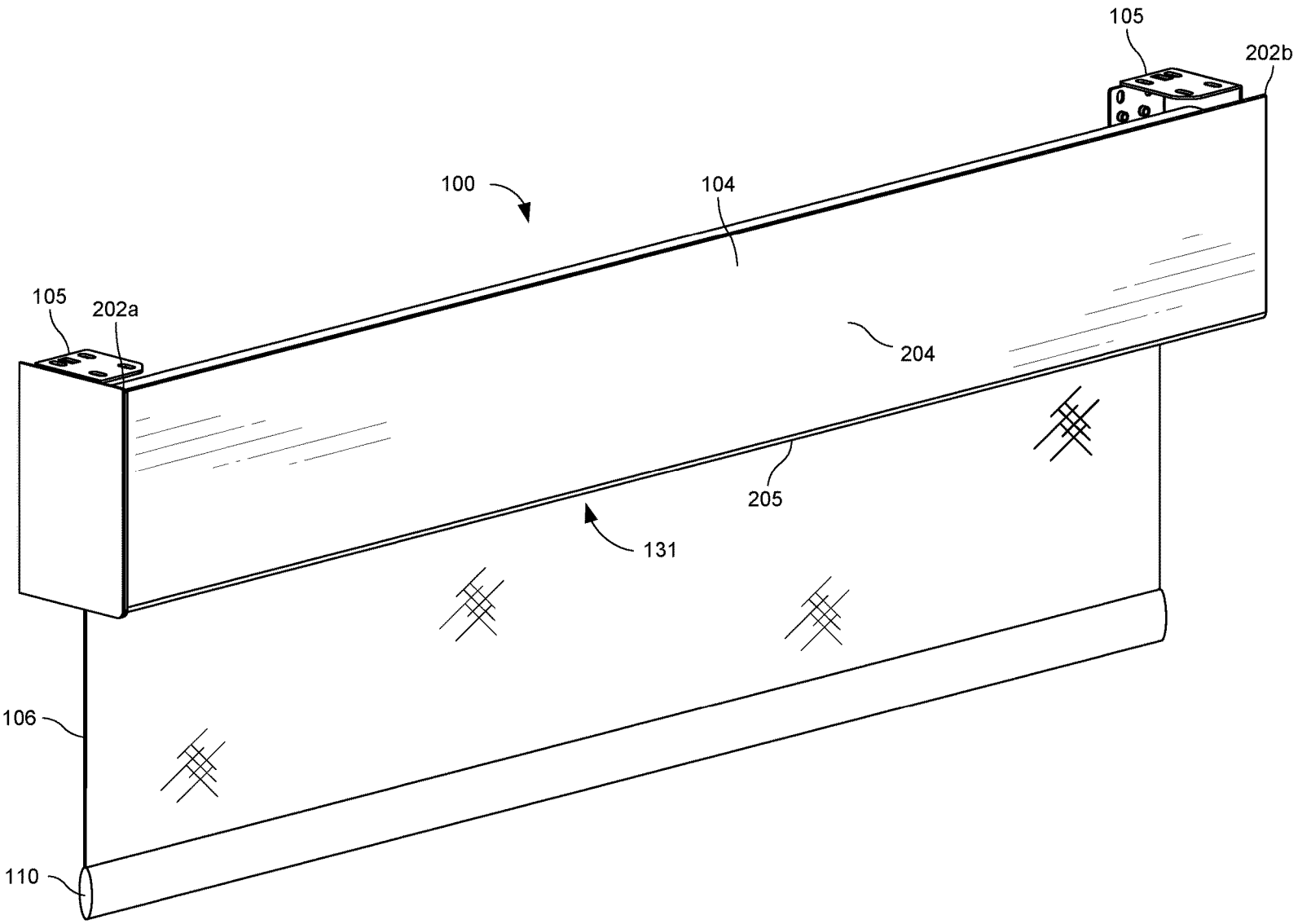

FIG. 5 illustrates a front view of the roller shade with the battery compartments in a retracted and hidden position according to an illustrative embodiment.

Figure 6:
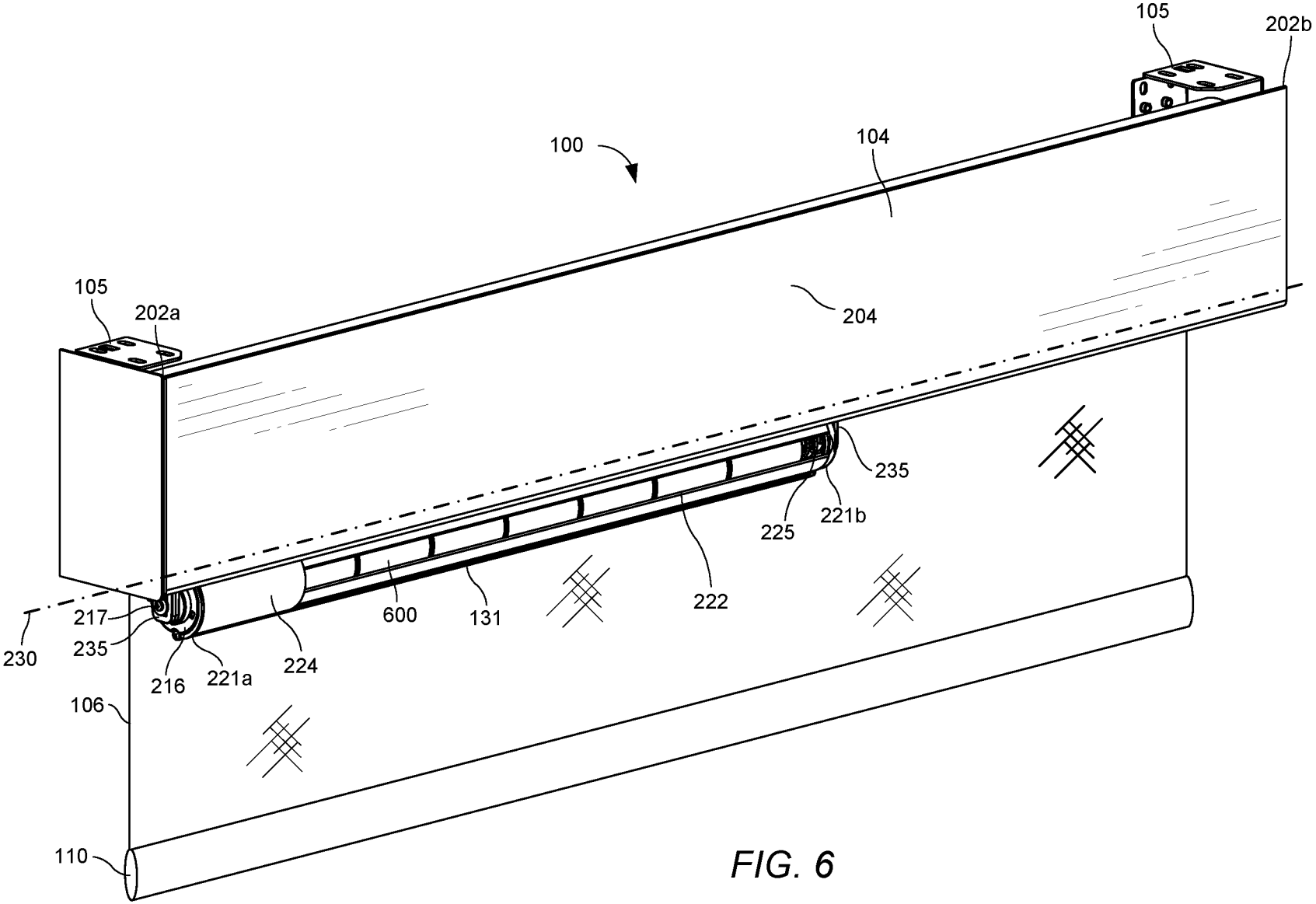

FIG. 6 illustrates a front view of the roller shade with the battery compartment in an extended position and with its door closed according to an illustrative embodiment.

Figure 7:
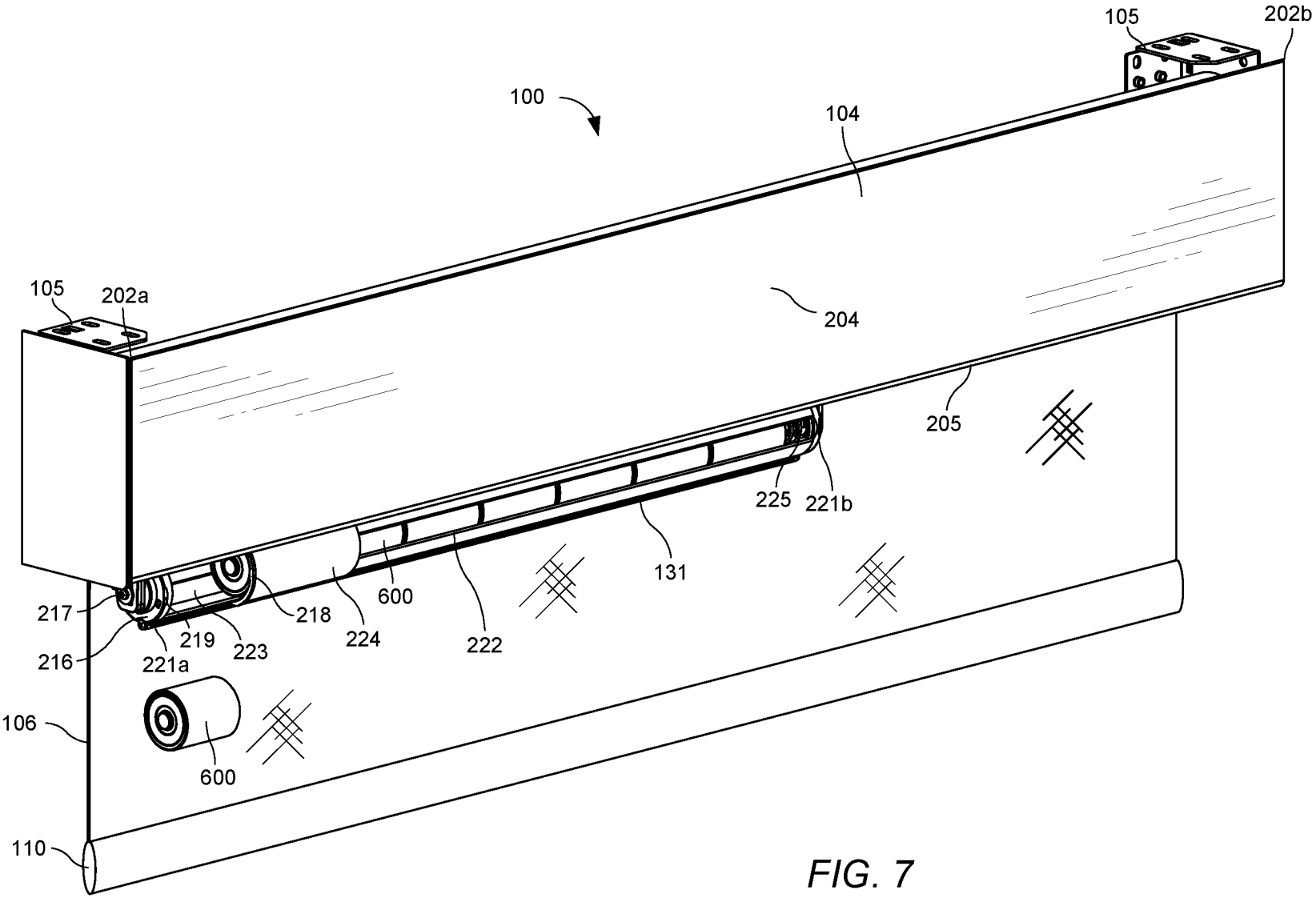

FIG. 7 illustrates a front view of the roller shade with the battery compartment in an extended position and with its door opened according to an illustrative embodiment.

Figure 8:
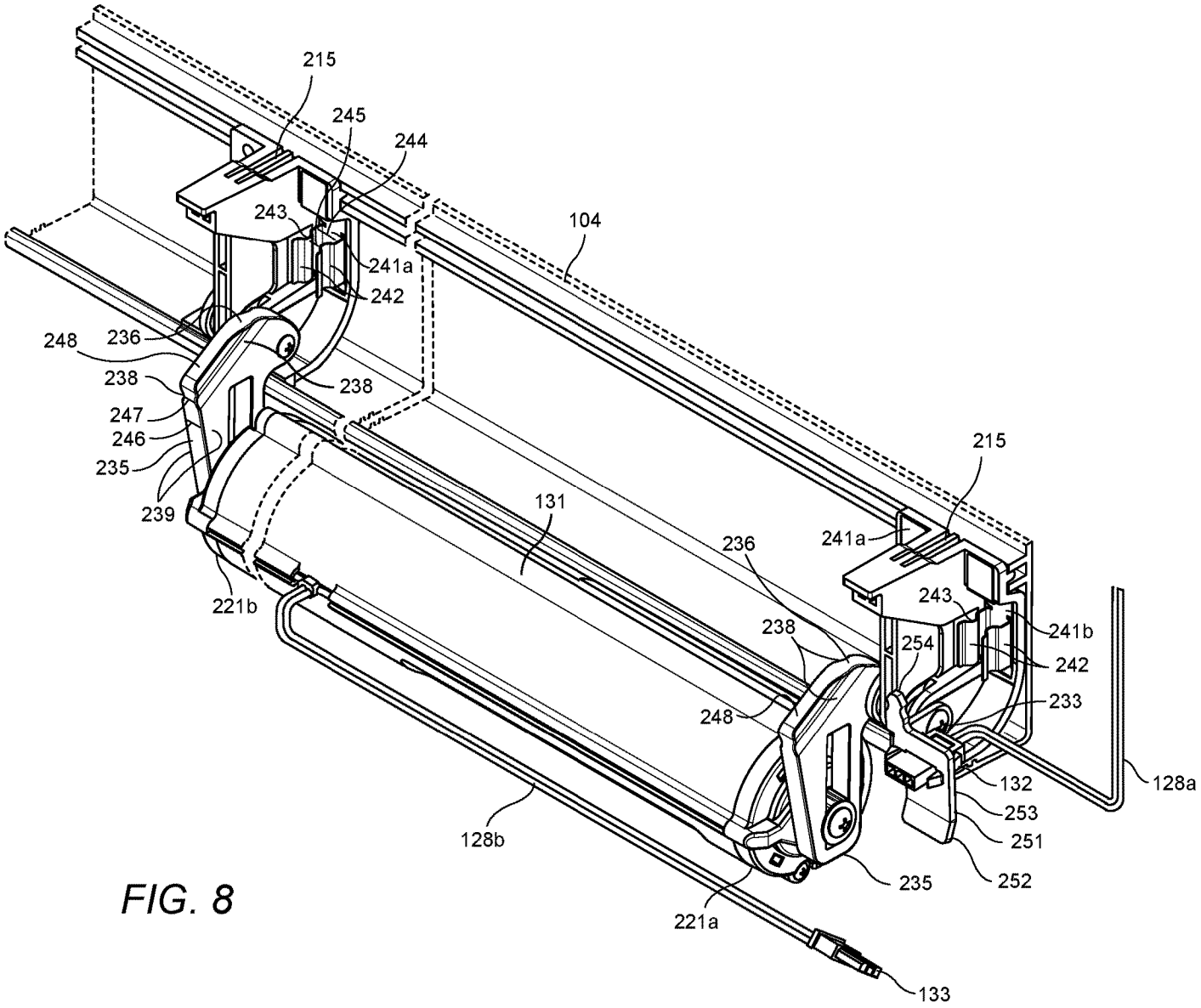

FIG. 8 illustrates a rear perspective view of the lower portion of the roller shade housing and the battery compartment in a fully extended position according to an illustrative embodiment.

Figure 9:
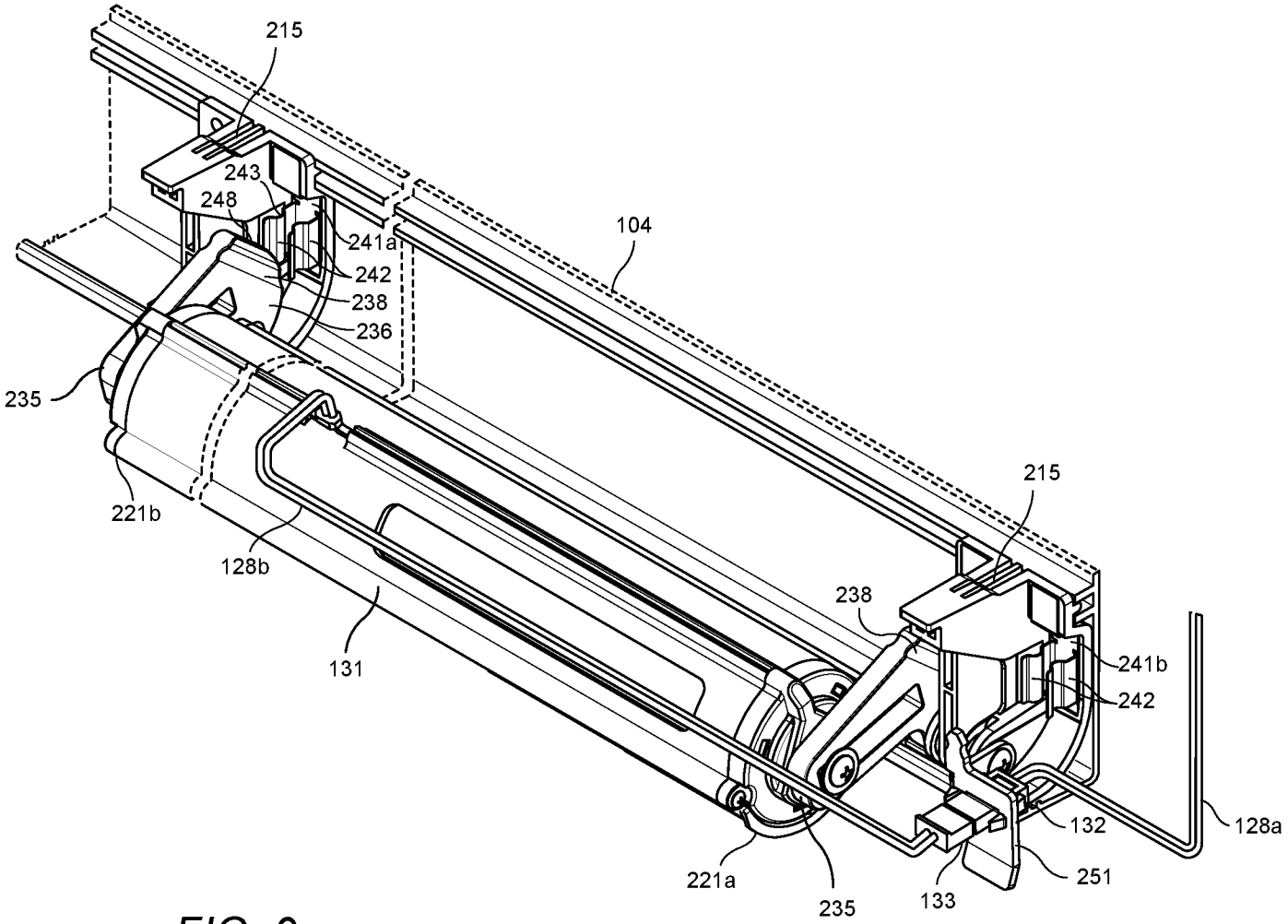

FIG. 9 illustrates a rear perspective view of the lower portion of the roller shade housing and the battery compartment in a partially extended position according to an illustrative embodiment.

Figure 10:
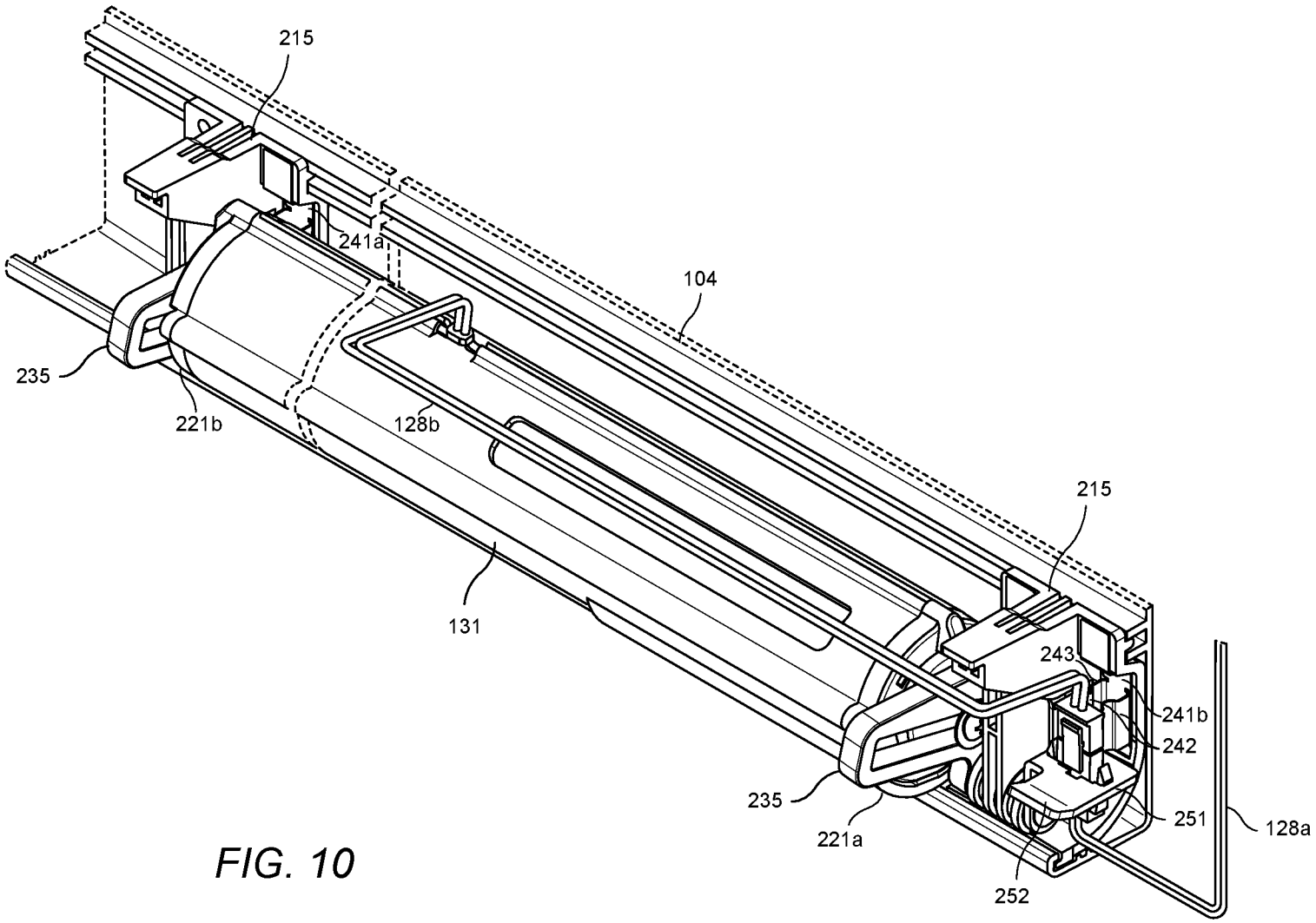

FIG. 10 shows a rear perspective view of the lower portion of the roller shade housing and the battery compartment in a hidden or retracted position according to an illustrative embodiment.

DETAILED DESCRIPTION OF THE INVENTION

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" or "in an embodiment" in various places throughout the specification is not necessarily referring to the same embodiment. Further, the particular feature, structures, or characteristics may be combined in any suitable manner in one or more embodiments.

LIST OF REFERENCE NUMBERS FOR THE ELEMENTS IN THE DRAWINGS IN NUMERICAL ORDER

The following is a list of the major elements in the drawings in numerical order.

100 Roller Shade
101 Roller Tube
102 Motor Drive Unit
103 Idler Assembly
104 Roller Shade Housing
105 Mounting Bracket(s)
106 Shade Material
107 Motor Housing
108 Idler Body
109 Idler Pin
110 Hem Bar
111*a* First End of Roller Tube
111*b* Second End of Roller Tube
112 Motor Control Module
115 Motor
116 Crown Adapter Wheel
117 Idler Crown Wheel
120 Counterbalancing Spring
121 Drive Wheel
122 First Stage Planetary Gear
123 Clutch
124 Final Stage Planetary Gear
125 Output Mandrel
127 Motor Head
128*a* First Power Cord
128*b* Second Power Cord
130 Power Supply
131 Battery Compartment
132 Connectivity Port
133 Connectivity Plug
202*a* First End of Roller Shade Housing
202*b* Second End of Roller Shade Housing
204 Front Wall
205 Bottom Wall
206 Intermediate Horizontal Wall
207 Opening
208 First Drop Down Position
209 Second Drop Down Position
210 Battery Replacement Position
211 First Housing Portion
212 Second Housing Portion
215 Battery Compartment Supporting Bracket(s)
216 End Cap(s)
217 Nipple(s)
218 Latch
219 Groove
221*a* First End of Battery Compartment
221*b* Second End of Battery Compartment
222 Channel
223 Battery Opening
224 Door
225 Biasing Spring
230 Pivot Axis
231 Screw
232 Shoulder(s)
233 Rivet/Screw
234 Channel
235 Swing Arm(s)
236 Proximal End
237 Distal End
238 Grooves
239 Outer Surface
241*a* Pair of First Retaining Clips
241*b* Second Retaining Clip
242 Spring Arms
243 Bulges
244 First Distance
245 Second Distance
246 First Thickness
247 Second Thickness
248 Flat Surface
251 Connector Bracket
252 Grip Portion
253 Port Retaining Portion
254 Clip Engaging Portion
401 Distance
405 Layers
600 Battery(s)

LIST OF ACRONYMS USED IN THE SPECIFICATION IN ALPHABETICAL ORDER

The following is a list of the acronyms used in the specification in alphabetical order.

ASICs Application Specific Integrated Circuits
BLDC Brushless Direct Current
DC Direct Current
IR Infrared
LED Light Emitting Diode
PCB Printed Circuit Board
PoE Power Over Ethernet
RAM Random-Access Memory
RF Radio Frequency
ROM Read-Only Memory

Mode(s) for Carrying Out the Invention

For 40 years Crestron Electronics, Inc. has been the world's leading manufacturer of advanced control and automation systems, innovating technology to simplify and enhance modern lifestyles and businesses. Crestron designs, manufactures, and offers for sale integrated solutions to control audio, video, computer, and environmental systems. In addition, the devices and systems offered by Crestron streamline technology, improving the quality of life in commercial buildings, universities, hotels, hospitals, and homes, among other locations. Accordingly, the systems, methods, and modes of the aspects of the embodiments described herein can be manufactured by Crestron Electronics, Inc., located in Rockleigh, N.J.

The different aspects of the embodiments described herein pertain to the context of battery operated roller shades, but is not limited thereto, except as may be set forth expressly in the appended claims. While the roller shade is described herein for covering a window, the roller shade may be used to cover other architectural openings, such as doors, wall openings, or the like. The embodiments described herein may further be adapted in other types of window or door coverings. For example, the battery compartment described herein may be placed in a shade housing designed to house an inverted roller, a Roman shade, an Austrian shade, a pleated shade, a blind type shade, a shutter type shade, a skylight shade, a garage door, or the like.

Disclosed herein are systems, methods, and modes for a battery operated roller shade, and more particularly to an architectural roller shade housing with adjustable battery compartment. Referring to FIG. 1, there is shown a rear perspective view of a battery operated roller shade 100 according to one aspect of the embodiments. Roller shade 100 generally comprises a roller tube 101, a motor drive unit 102, an idler assembly 103, shade material 106, and a hem bar 110. Shade material 106 is connected at its top end to the roller tube 101 and at its bottom end to the hem bar 110. The motor drive unit 102 is adapted to raise or lower the shade material 106 to adjustably cover or uncover a structural opening, such as a window, a door, a wall opening, or the like. For example, in a roller shade application, shade material 106 wraps around the roller tube 101 and is wrapper or unwrapped from the roller tube 101*b* y rotation of the roller tube 101*b* y the motor drive unit 102. In various embodiments, the shade material 106 comprises fabric, plastic, vinyl, or other materials known to those skilled in the art.

Roller tube 101 is generally cylindrical in shape and longitudinally extends from a first end 111*a* to a second end 111*b*. In various embodiments, the roller tube 101 comprises aluminum, stainless steel, plastic, fiberglass, or other materials known to those skilled in the art. The first end 111*a* of the roller tube 101 may receive the motor drive unit 102 and the second end 111*b* of the roller tube 101 may receive the idler assembly 103, although the placement of the motor drive unit 102 and the idler assembly 103 may be reversed.

The idler assembly 103 of the roller shade 100 may comprise an idler body 108 rotatably connected about the idler pin 109. The idler assembly 103 is inserted into the second end 111*b* of the roller tube 101 and operably connected to the roller tube 101 such that rotation of the roller tube 101 also rotates the idler body 108. The idler body 108 may comprise ball bearings therein (not shown) allowing the idler body 108, and thereby the roller tube 101, rotate with respect to the idler pin 109.

During installation, the roller shade 100 is mounted on or in a window between a pair of mounting brackets 105. The mounting brackets can comprise similar configuration to the CSS-ARCH3 QMT3 Series Architectural Shade Hardware, available from Crestron Electronics, Inc. of Rockleigh, N.J. Other types of brackets may be utilized without departing from the scope of the present embodiments. The mounting brackets 105 in turn can be surface-mounted on a wall or ceiling or recess-mounted in a pocket or window jamb. The terminal end of the idler pin 109 may attach the roller shade 100 to one of the mounting brackets 105. The roller shade 100 may then be mounted to the other mounting bracket 105 by snapping the motor head 127 of the motor drive unit 102 to the mounting bracket 105 or coupling the motor drive unit 102 to the mounting bracket 105 using screws.

The motor drive unit 102 may comprise a motor head 127 including a crown adapter wheel 116, a motor housing 107 containing a motor control module 112 and motor 115 therein, an idler crown wheel 117, an output mandrel 125, a counterbalancing spring 120, and a drive wheel 121. The motor drive unit 102 may be inserted into the roller tube 101 from the first end 111*a*. The crown adapter wheel 116, idle crown wheel 117, and drive wheel 121 may be generally cylindrical in shape and may comprise a plurality of channels extending circumferentially about their external surfaces that mate with complementary projections radially extending from an inner surface of roller tube 101 such that crown adapter wheel 116, idle crown wheel 117, drive wheel 121, and roller tube 101 rotate together during operation. The drive wheel 121 is operably connected to the motor output shaft of the motor 115 via the output mandrel 125 such that rotation of the motor output shaft also rotates the drive wheel 121. The crown adapter wheel 116 and idle wheel 117 may be rotatably attached at two opposite ends of the motor housing 107 via ball bearings to hold the motor 115 concentric to the roller tube 101.

The motor 115 may comprise a brushless direct current (BLDC) electric motor. In another embodiment, the motor 115 comprises a brushed direct current (DC) motor, or any other motor known in the art. In operation, the roller shade 100 is rolled down and rolled up via the motor drive unit 102. Particularly, the motor 115 drives the drive wheel 121, which in turn engages and rotates the roller tube 101. The roller tube 101, in turn, engages and rotates the crown adapter wheel 116, idle crown wheel 117, and idler body 108 with respect to the motor 115, while the motor housing 107, including the motor 115 and motor control module 112, remain stationary. The motor 115 may drive the drive wheel 121 through a series of components that in combination provide efficiency and counterbalancing to the roller shade 100, such as a first stage planetary gear 122, a clutch 123, a final stage planetary gear 124, an output mandrel 125, and a counterbalancing spring 120. In one embodiment, the first and final stage planetary gears 122 and 124 may be configured for providing speed reduction and torque increase to achieve efficient operation of the motor 115. According to another embodiment, the first and final stage planetary gears 122 and 124 may be configured for providing increased speed and decreased torque. The spring 120 may be pretensioned in the factory using the motor 115. The pretensioned counterbalancing spring 120 assists the motor 115 to roll up the shade material 106 throughout the rolling up cycle without the motor 115 requiring to exert much power. According to an embodiment, the motor drive unit 102 may comprise similar configuration to the motor drive unit disclosed in U.S. Pat. No. 10,738,530, filed Jan. 16, 2018 and issued Aug. 11, 2020, titled "Motor Pretensioned Roller Shade," the entire contents of which are hereby incorporated by reference.

The motor control module 112 operates to control the motor 115, directing the operation of the motor, including its direction, speed, and position. The motor control module 112 may comprise fully integrated electronics housed on a single or a plurality of printed circuit boards (PCBs). The motor control module 112 may comprise a controller, a memory, a communication interface, a user interface, and a light indicator. The user interface may comprise buttons, such as open and close, as well as a setup button that may allow the user to set the upper limit, the lower limit, the battery replacement limit (discussed below), reverse motor direction as well as assist in acquiring shades to the control system and any other intermediary devices necessary. The buttons may be arranged on the motor drive unit 102 such that they are visible from the front or bottom of the motor drive unit 102. The light indicator, such as a multicolor light emitting diode (LED), may be adapted to display device status, any error feedback, status blink codes, as well as the battery status, such as low-battery conditions. The controller can represent one or more microprocessors, and the microprocessors can be "general purpose" microprocessors, a combination of general and special purpose microprocessors, or application specific integrated circuits (ASICs). The controller provides processing capability for one or more of the techniques and functions described herein. The memory can be communicably coupled to controller and can store data and executable code. In another embodiment, memory is integrated into the controller. The memory can represent volatile memory such as random-access memory (RAM), but can also include nonvolatile memory, such as read-only memory (ROM) or Flash memory.

The communication interface may comprise a wireless communication interface configured for bidirectional communication with other electronic devices over a communications network. A wireless interface can comprise a radio frequency (RF) transceiver, an infrared (IR) transceiver, trace antenna, or other communication technologies known to those skilled in the art. The wireless interface may communicate using a communication protocol, such as the infiNET EX® protocol from Crestron Electronics, Inc. of Rockleigh, N.J., ZigBee® protocol from ZigBee Alliance, Bluetooth, or the like.

The control commands received by the motor control module 112 may be a direct user input to the controller from the user interface or a wireless signal from an external control point. For example, the motor control module 112 may receive a control command from a wall-mounted button panel or a touch-panel in response to a button actuation or similar action by the user. Control commands may also originate from a signal generator such as a timer or a sensor. Accordingly, the motor control module 102 can integrate seamlessly with other control systems using the communication interface to be operated from keypads, wireless remotes, touch screens, and wireless communication devices, such as smart phones. Additionally, the motor control module 102 can be integrated within a large scale building automation system or a small scale home automation system and be controllable by a central control processor, such as the PRO3 control processor available from Crestron Electronics, Inc., that networks, manages, and controls a building management system.

The motor drive unit 102 may be connected to a replaceable power supply 130, such as a plurality of serially arranged batteries. Power supply 130 provides power to the circuitry of the motor control module 112, and in turn the motor 115. The motor control module 112 may be connected to the power supply 130, such as batteries, through one or more power cords 128*a-b* and one or more connectivity ports 132 and/or plugs 133. In yet another embodiment, the motor control module 112 may also be connected to a solar panel or a solar collection module placed in proximity to the window to aggregate solar energy and recharge the batteries. Power supply 130 may comprise a battery compartment 131 adapted to house batteries therein.

Referring to FIGS. 1-7, where FIG. 2 illustrates a side view of the battery operated roller shade 100 with the battery compartment 131 in a retracted or hidden position within the roller shade housing 104, FIG. 3 illustrates a side view of the roller shade 100 with the battery compartment 131 in a partially extended position with respect to the roller shade housing 104, FIG. 4 illustrates a side view of the roller shade 100 with the battery compartment 104 in a fully extended position; FIG. 5 illustrates a front perspective view of the roller shade 100 with the battery compartment 131 in a retracted or hidden position, FIG. 6 illustrates a front perspective view of the roller shade 100 with the battery compartment 131 in an extended position and with its door 224 closed, and FIG. 7 illustrates a front view of the roller shade 100 with the battery compartment 131 in an extended position and with its door 224 opened.

As seen in FIGS. 1-2, the roller shade 100 further comprises housing 104 which may comprise a first housing portion 211 a second housing portion 212. The first housing portion 211 may at least partially cover or conceal the roller tube 101 from view, including the motor drive unit 102 therein, as well as any of the shade material 106 wrapped around the roller tube 101. The second housing portion 212 may at least partially cover or conceal the battery compartment 131 from view when it is in a retracted position as shown in FIGS. 2 and 5. According to an embodiment, as shown in FIG. 2, the housing 104 may consist of a decorative fascia comprising a front wall 204 that covers the front of the roller tube 101 as well as the battery compartment 131. The housing 104 may further comprise a bottom wall 205 that partially covers the bottom of the roller tube 101 as well as the battery compartment 131 from view. The housing 104 may further comprise an intermediate horizontal wall 206 extending from an inner surface of the front wall 204 to partially segregate the roller tube 101 and battery compartment 131. According to an embodiment, the bottom wall 205 may be flat resulting in a square fascia, as shown in FIG. 2, or alternatively it may be partially curved resulting in a curved fascia. According to a further embodiment, additional covers, such as top and back covers, and a blackout extrusion can be attached to the side mounting brackets 105 or the fascia's front wall 204 to provide additional coverage or blackout for the top and back of the roller tube 101. According to another embodiment, the housing 104 may instead comprise a pocketed construction consisting of a U-shaped extrusion that covers the front, top, and back of the roller tube 101. Alternatively, a G-shaped housing 104 may be used that also partially covers the bottom of the roller tube 101.

Irrespective of the housing type or shape, the housing 104 defines an opening 207 at the bottom that allows the shade material 106 to drop down from the roller tube 101 and out of the housing 104. The housing 104 may be connected to and supported by the pair of oppositely disposed mounting brackets 105, for example by having the fascia snap on the front of each of the mounting brackets 105. Although in other embodiment, the mounting brackets 105 and housing 104 may be an integral component. Referring to FIG. 5, the housing 104 may span the width of the roller tube 101 and may longitudinally extend from a first end 202*a* to a second end 202*b*. Referring to FIGS. 1 and 2, two battery compartment supporting brackets 215 may be connected to the housing 104, each adapted to support and rotatably connect the battery compartment 131 to the housing 104. The housing 104 may comprise a pair of shoulders 232 spaced to retain the battery compartment supporting brackets 215 therebetween. Each supporting bracket 215 may be further secured to the roller shade housing 104 using screw 231.

The battery compartment 131 may be secured to the housing 104 at a position below the roller tube 101 such that it does not impede with the travel of the shade material 106 and/or the hem bar 110 when the battery compartment 131 is in a retracted position. Particularly, when the shade material 106 is raised or lowered between its upper and lower limits, it tends to translate laterally with respect to the roller tube 101—for example from a first drop down position 208 (FIG. 2), where the shade material 106 is substantially fully lowered or fully unrolled from the roller tube 101 (i.e., at the lower limit), to a second drop down position 209, where the shade material 106 is substantially raised or substantially rolled on the roller tube 101 (i.e., at the upper limit). This is because as the shade material 106 rolls on the roller tube 101, the shade material 106 layers on the roller tube 101 causing the diameter of the shade material 106 on the roller tube 101 to increase and result in the lateral movement of the shade material 106. As such, the drop down position of the shade material 106 is continuously displaced. Accordingly, the battery compartment 131 is secured to the housing 104 at a retracted position shown in FIG. 2 at sufficient distance from the shade material 106 and hem bar 110 such that the battery compartment 131 does not contact the shade material 106 or the hem bar 110 whether it is fully raised or lowered during operation.

The battery compartment 131 may comprise a tubular body or enclosure designed to maintain a compact and discrete appearance that is easily accessible for battery replacement. Battery compartment 131 longitudinally extends from a first end 221*a* to a second end 221*b*, each attached to a respective battery compartment supporting bracket 215. The battery compartment 131 may be made from a lightweight material, such as plastic or a light weight metal extrusion, although other materials may be utilized. The battery compartment 131 may comprise a pair of end caps 216 adapted to close the first and second ends 221*a* and 221*b* of the battery compartment 131. Although according to an alternative embodiment, the battery compartment 131 may comprise a single tubular enclosure with integrated closed ends. The battery compartment 131 may be shaped and sized to receive a plurality of batteries arranged in series within the battery compartment 131, for example, eight Alkaline D' cell batteries 600 (FIG. 7). According to other embodiments, other battery number and sizes may be utilized, such as 'A', 'AA', 'C', or 'PP3' cells, or equivalent rechargeable options.

As shown in FIG. 7, the battery compartment 131 may comprise a battery opening 223 traversely extending through its side surface and adapted and sized to receive a battery 600 therethrough and into the battery compartment 131. The opening 223 may be disposed adjacent to a first end 221*a* (or the second end 221*b*) of the battery compartment 131. The battery compartment 131 may also comprise a channel 222 that traverses its surface and longitudinally extends from the battery opening 223 to the second end 221*b* of the battery compartment 131. The batteries 600 may be loaded one by one into the battery compartment 131 through the battery opening 223 at the first end 221*a* and may be slid towards the second end 221*b* by accessing the batteries 600 using the longitudinal channel 222 until the battery compartment 131 is full. The battery compartment 131 may comprise a biasing spring 225 adapted to bias and retain the batteries 600 within the battery compartment 131. The battery compartment 131 may further comprise a pair of contacts therein proximate to its first and second ends 221*a-b* that may be connected via power cords 128*a-b* to the motor control module 112 (FIG. 1) to provide contact and power to the batteries 600 therein.

The battery compartment 131 may further comprise a door 224 disposed over the battery opening 223. The door 224 may be adapted to slide from a closed position where it closes the battery opening 223, as shown in FIG. 6, to an opened position where it exposes the battery opening 223 permitting batteries 600 to be inserted therethrough (FIG. 7). According to an embodiment, the door 224 may be biased using a spring to generally maintain the door 224 in a closed position (FIG. 6). As such, the door 224 may be slid by a user to an open position (FIG. 7) to insert the batteries 600, and may automatically slide to the closed position via the biasing spring (FIG. 6) once it is let go. According to another embodiment, the door 224 may comprise a latch 218 that fastens the door 224 to a mating groove 219 disposed on the end cap 216 of battery compartment 131 when the door 224 is in the closed position. To slide the door 224 to an opened position, force is required to unfasten the latch 218 from the groove 219 by pulling on the door 224 away from the end cap 216. When closing the door 224, the door 224 will need to get pushed in until hearing a clicking sound indicating that the door latch 218 is fastened to the groove 219 on the end cap 216 of battery compartment 131.

Referring to FIGS. 2 and 3, each end cap 216 of the battery compartment 131 may comprise a nipple 217 (FIG. 3) laterally extending therefrom. Each battery supporting bracket 215 may further comprise an L-shaped swing arm 235 that may be pivotally secured at its proximal end 236 to the battery supporting bracket 215, and thereby with respect to the roller shade housing 104, using a rivet or a screw 233 about a pivot axis 230. Swing arm 235 may comprise a longitudinal channel 234 extending therethrough from in proximity to its proximal end 236 to in proximity to its distal end 237. Each nipple 217 on a respective end cap 216 is adapted to slide within and along a respective channel 234 within the swing arm 235.

During normal operation of the roller shade 100, the battery compartment 131 is maintained in the retracted position shown in FIGS. 1, 2, and 5 where the battery compartment 131 is tucked in within the second housing portion 212 of the roller shade housing 104, and hidden by front wall 204 and at least partially by the bottom wall 205. In the retracted position, each swing arm 235 is positioned within the second housing portion 212 such that the channel 234 is oriented at about 45 degree angle with respect to the front wall 204 of the roller shade housing 104. In this position, the channel 234 is declined towards the proximal end 236 of the swing arm 235. The decline of channel 234 causes each nipple 217, and thereby the battery compartment 131, to be positioned within a respective channel 234 proximate to the proximal end 236 of the swing arm 235, and thereby tucked in proximate the front wall 204 of the roller shade housing 104 and away from the shade material 106 and hem bar 110.

According to an embodiment, the motor control module 112 may include battery status monitoring to help users in determining when the batteries 600 need replacement. The motor control module 112 may include circuitry to monitor the power of the batteries through power cords 128*a-b* (FIG. 1). With battery status monitoring, the motor control module 112 may send out alerts, letting service providers and/or end users know when battery replacement is needed. For example, once the battery power reaches a minimum battery threshold, the motor control module 112 may inform the user that the batteries need to get changed, for example, using a native user interface on the motor drive unit 102 or an external user interface point. For example, the motor control module 112 may blink LED in a red color.

In addition, once determining that the battery power has reached the minimum battery threshold (or a second minimum battery threshold different from the minimum battery threshold for issuing the low battery alert), the motor control module 112 may direct the shade material 106 to move to the preset battery replacement limit such that the hem bar 110 is located at a battery replacement position. For example, referring to FIG. 4, the battery replacement position 210 may be a position where the hem bar 110 is positioned at a predetermined distance 401 below the opening 207 at the bottom end of the roller shade housing 104. At this battery replacement position 210, the shade material 106 may be substantially, but not fully, raised or rolled up on the roller tube 101 (i.e., below the upper limit 209). As such, the shade material 106 is at a position that is somewhat below the fully-opened position. The layers 405 formed by the shade material 106 on the roller tube 101 cause the shade material 106 to hang at a drop down position 210 that is farther away from the battery compartment 131 than drop down position 208 when the shade material 106 is fully unraveled from the roller tube 101. Being farther away provides more space for the battery compartment 131 to swing down from the shade housing 104. In addition, at the battery replacement position 210, the hem bar 110 is positioned at a sufficient distance 401*b* below the opening 207 such that it not in a way when the battery compartment 131 is swung down to an extended position shown in FIG. 4. According to an embodiment, the battery replacement position 210 may be a factory preset limit, or a battery replacement limit preset by the installer.

According to an embodiment, the minimum battery threshold may correspond to the minimum runtime required to raise the shade material 106 from a fully lowered or rolled down position 208 (i.e., lower limit) to the battery replacement position 210. As such, if the hem bar 110 is positioned below the battery replacement position 210 (for example when the roller shade 100 is fully closed or partially closed), and if the motor control module 112 detects that the battery power level is at or below the minimum battery threshold, the motor control module 112 may raise the shade material 106 until the hem bar 110 is position at the battery replacement position 210. Similarly, if the hem bar 110 is positioned above the battery replacement position 210 (for example when the roller shade 100 is fully opened as shown in FIG. 2), and if the motor control module 112 detects that the battery power level is at or below the minimum battery threshold, the motor control module 112 may lower the shade material 106 until the hem bar 110 is position at the battery replacement position 210. The motor control module 112 may then disable the motor 115 from raising or lowering the shade material 106 until the batteries 600 are replaced. Meanwhile, the motor control module 112 may alert the user that batteries 600 need replacement, as discussed above.

To replace the batteries, each swing arm 235, and thereby the battery compartment 102, may swivel out of the second housing portion 212 about the pivot axis 230 and down through opening 207 in the roller shade housing 104 as shown in FIG. 3 to the extended position shown in FIG. 4. As such, the battery compartment 102 swings down to replace the batteries 600 without removing or moving the roller shade 100 or the roller shade housing or facia 104. As the battery compartment 104 swings out via the swing arm 235, the channel 234 of the swing arm 235 translates from being declined towards the proximal end 236 of the swing arm 235 to being declined towards the distal end 237 of the swing arm 235. This causes the nipples 217 of endcaps 216 to slide along the channel 234 towards the distal end 237 of the swing arm 235 as shown in FIGS. 3 and 4. As such, in fully extended position shown in FIG. 4, each swing arm 235 is positioned outside the second housing portion 212 such that the respective channel 234 is oriented substantially parallel to the front wall 204 of the roller shade housing 104 and the battery compartment 104 hangs at the distal end 237 of the swing arm 235. The L-shaped swing arm 235 and the longitudinal channel 234 therein help to decrease the radius of rotation of the battery compartment 131 with respect to the roller shade housing 104 about pivot axis 230. This allows the roller shade housing 104 to maintain a small profile while allowing the battery compartment 131 to exit the opening 207 in the roller shade housing 104 and provide the necessary access to the batteries 600 in the compartment 131 in the extended position shown in FIGS. 4 and 6.

As shown in FIGS. 4 and 6, when the battery compartment 131 is swung down, door 224 faces the front of the roller shade 100. According to an embodiment, the biased door 224 will remain closed to prevent the batteries 600 from falling out of the battery compartment 131 during replacement. The user may then slide and open the door 224 to access the battery opening 223 and replace the batteries 600 as shown in FIG. 7. Once the batteries 600 are replaced, the user may release the door 224 to close the battery opening 223 and tilt the battery compartment 131*b* back into the second housing portion 212 behind the front wall 204 of the roller shade housing 104. The decline of channel 234 toward the proximal end 236 will cause each nipple 217, and thereby the battery compartment 131, to travel along the channel 234 to a positioned proximate to the proximal end 236 of the swing arm 235 and thereby proximate the front wall 204 of the roller shade housing 104. The motor control module 112 may then determine that the battery power has raised above the minimum battery threshold and reactivate the operation of the motor 115 to raise or lower the shade material 106.

According to an embodiment, the battery compartment 104 may comprise a release latch or lever (not shown) that generally keeps the battery compartment 104 retained in the retracted position shown in FIGS. 2 and 5. The release latch may release the battery compartment 104 when it is engaged by a user such that the battery compartment 104 swivels and drops down to the extended position shown in FIG. 4, for example via gravity.

According to another embodiment, the battery compartment 104 may be maintained in a retracted position shown in FIG. 2 via a locking mechanism, such as a magnetic lock. The magnetic lock may be operated using the motor control module 112. Once the battery power falls at or below the minimum battery threshold, the motor control module 112 may actuate the magnetic lock to release the battery compartment 104 such that it can drop to the extended position shown in FIG. 4. Although other types of locks or levers operable by the motor control module 112 may be alternatively utilized.

Another embodiment of securing the battery compartment 104 in the retracted position is shown in FIGS. 8-10, where FIG. 8 shows a rear perspective view of the lower portion of the roller shade housing 104 and the battery compartment 131 in a fully extended position, FIG. 9 shows the battery compartment 131 in a partially extended position, and FIG. 10 shows the battery compartment 131 in a hidden or retracted position. First referring to FIG. 8, the battery compartment supporting bracket 215 may comprise a pair of first retaining clips 241*a* disposed on the inner sides of the pair of supporting brackets 215. Each retaining clip 241*a* may comprise a pair of oppositely disposed spring arms 242 that are biased toward each other but spaced apart by a first distance 244. The spring arms 242 may comprise bulges 243 inwardly extending toward each other and forming a second distance 243 therebetween that is smaller than the first distance 244. Each swing arm 235 may comprise an oppositely disposed outer surfaces 239 defining a first thickness 246 therebetween and a substantially flat surface 248 laterally disposed proximate to the proximate end 236. Each outer surface 239 may comprise a groove 238 longitudinally extending proximate and parallel to but spaced away from the flat surface 248. The general first thickness 246 of each swing arm 235, including at the proximal end 236, is larger than the second thickness 247 of the swing arm 235 between the grooves 238. Each groove 238 is shaped and sized to receive the bulge 243 extending from one of the spring arms 242 of the retaining clip 241*a*. The general first thickness 246 of the swing arm 235 is equal to or slightly smaller than the first distance 244 between the spring arms 241*a* but is larger than the second distance 245 between the bulges 243. The second thickness 247 between the grooves 238 is equal to or slightly smaller than the second distance 245 between the bulges 243.

After the batteries are replaced, the battery compartment 131 may be rotated back inside the roller shade housing 104. The thicker portions of the proximal ends 236 of the swing arms 235 comprising the first thickness 246 will enter the retaining clips 241*a*, push against the bulges 243, and force the spring arms 242 apart as shown in FIG. 9. When the proximal ends 236 of the swing arms 235 fully enter the retaining clips 241*a*, the bulge 243 on each spring arm 242 will enter and bias against a respective groove 238 on the swing arm 235, causing the swing arms 235 to be retained by the retaining clips 241*a* as shown in FIG. 10. To disconnect the battery compartment 131, the battery compartment 131 can be pulled away from the front wall 205 of the battery compartment 104 until the swing arms 235 are disengaged from the pair of the first retaining clips 241*a*.

Referring to FIG. 8, the battery compartment support bracket 215 proximate to the first end 221*a* of the battery compartment 131 may comprise a second retaining clip 241*b* with substantially the same construction as the first retaining clips 241*a*. That support bracket 215 may further comprise a connector bracket 251 disposed on the opposite side of the swing arm 235 and pivotally secured to the battery supporting bracket 215 using a rivet or a screw 233. Connector bracket 251 may comprise a grip portion 252, a port retaining portion 253, and a clip engaging portion 254 located on substantially the same surface of the connector bracket 251. The grip portion 252 extends from the connector bracket 251 to enable a user to grip the connector bracket 251. The port retaining portion 253 is used to support a connectivity port 132 therein. The connectivity port 132 is connected to the motor drive unit 102 via a first power cord 128*a*. The clip engaging portion 254 is sized and shaped to be clipped by the second retaining clip 241*b* in the substantially same manner as discussed above with reference to swing arms 235 and clips 241*a*. The battery compartment 131 comprises a second power cord 128*b* connected to electrical contacts within the battery compartment 131 on one end and to a connectivity plug 133 on the other end.

After the batteries 600 are replaced and the battery compartment 131 is in the retracted position and retained by the pair of the first retaining clips 241*a* as shown in FIG. 10, the user may connect the connectivity plug 133 to the connectivity port 132 while the connector bracket 251 is in the extended position shown in FIG. 9. Then the user may swing the connector bracket 251 until the clip engaging portion 254 is retained by the second retaining clip 241*b* as shown in FIG. 10. To disconnect, the user may grip the grip portion 252 of the connector bracket 251 and pull until the clip engaging portion 254 disconnects from the second retaining clip 241*b*. Then the user can pull and disengage the connectivity plug 133 from the connectivity port 132.

INDUSTRIAL APPLICABILITY

The disclosed embodiments provide a system, software, and a method for an improved architectural roller shade housing with adjustable battery compartment that is easily accessible by the user. It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

Additionally, the various methods described above are not meant to limit the aspects of the embodiments, or to suggest that the aspects of the embodiments should be implemented following the described methods. The purpose of the described methods is to facilitate the understanding of one or more aspects of the embodiments and to provide the reader with one or many possible implementations of the processed discussed herein. The steps performed during the described methods are not intended to completely describe the entire process but only to illustrate some of the aspects discussed above. It should be understood by one of ordinary skill in the art that the steps may be performed in a different order and that some steps may be eliminated or substituted.

All United States patents and applications, foreign patents, and publications discussed above are hereby incorporated herein by reference in their entireties.

Alternate Embodiments

Alternate embodiments may be devised without departing from the spirit or the scope of the different aspects of the embodiments.

What is claimed is:

1. A battery operated shade adapted to adjustably cover a structural opening comprising:

a shade material extending from a top end to a bottom end;

a motor drive unit operably connected to the top end of the shade material to raise and lower the shade material between an upper limit and a lower limit to adjustably cover and uncover the structural opening;

a shade housing adapted to at least partially conceal the motor drive unit, wherein the shade housing comprises an opening from which the shade material exits the shade housing;

a battery compartment adapted to removably retain batteries for providing power to the motor drive unit; and a pair of swing arms each comprising a proximal end pivotally connected to the shade housing and a distal end connected to the battery compartment;

wherein the pair of swing arms are adapted to pivot with respect to the shade housing to swivel the battery compartment from a first position, where the battery compartment is at least partially concealed by the shade housing and the pair of swing arms are retained within the shade housing by a pair of retaining clips, to a second position, where the battery compartment extends out of the shade housing.

2. The battery operated shade of claim 1, wherein each retaining clip comprises a pair of oppositely disposed spring arms biased toward each other, wherein the proximal end of each swing arm is retained between the spring arms of the respective retaining clip when the battery compartment is in the first position.

3. The battery operated shade of claim 2, wherein the spring arms of each retaining clip comprise bulges inwardly extending toward each other and wherein the proximal end of each swing arm comprise grooves shaped and sized to receive the bulges therein to maintain the battery compartment in the first position.

4. The battery operated shade of claim 1 further comprising a pair of support brackets each comprising one of the pair of swing arms, wherein the pair of support bracket connect the pair of swing arms to the shade housing.

5. The battery operated shade of claim 1 further comprising a connector bracket pivotally connected to the shade housing, wherein the connector bracket is adapted to swivel with respect to the shade housing from a first position where the connector bracket is at least partially concealed by the shade housing to a second position where the connector bracket is at least partially extends out of the shade housing, wherein the connector bracket comprises a port retaining portion adapted to retain a port for electrically connecting the battery compartment to the motor drive unit, wherein the connector bracket is retained within the shade housing by a third retaining clip when the connector bracket is in the first position.

6. The battery operated shade of claim 5, wherein the third retaining clip comprises a pair of oppositely disposed spring arms biased toward each other, wherein the connector bracket comprises a clip engaging portion adapted to be retained between the spring arms of the third retaining clip.

7. The battery operated shade of claim 6, wherein the spring arms of the third retaining clip comprise bulges inwardly extending toward each other and wherein the clip engaging portion comprises grooves shaped and sized to receive the bulges therein to maintain the connector bracket in the first position.

8. The battery operated shade of claim 1, wherein the battery compartment is slidably connected to the pair of swing arms such that it slides with respect to the swing arms between their distal end and proximal end.

9. The battery operated shade of claim 8, wherein each swing arm comprises a longitudinal channel extending from about its proximal end to about its distal end, wherein the battery compartment comprises nipples in each of its ends adapted to slide within the longitudinal channel in each swing arm.

10. The battery operated shade of claim 9, wherein when the swing arms and thereby the battery compartment are in the first position, the battery compartment is positioned proximate to the proximal ends of the swing arms, and wherein when the swing arms and thereby the battery compartment are in the second position, the battery compartment is positioned proximate to the distal ends of the swing arms.

11. The battery operated shade of claim 1, wherein the battery compartment extends out of the shade housing through the opening in the shade housing.

12. The battery operated shade of claim 11, wherein the battery compartment is attached to the shade housing below the motor drive unit, wherein the opening in the shade housing is located below the battery compartment.

13. The battery operated shade of claim 12, wherein the shade housing comprises a front wall connected to a bottom wall that defines the opening.

14. The battery operated shade of claim 1, wherein the battery compartment comprises a battery opening that traversely extends through a side surface of the battery compartment.

15. The battery operated shade of claim 14, wherein the battery compartment comprises a door adapted to translate from a closed position where it closes the battery opening to an opened position where it exposes the battery opening.

16. The battery operated shade of claim 15, wherein the door comprises a latch adapted to removably fasten to a mating groove disposed on the battery compartment to maintain the door in a closed position.

17. The battery operated shade of claim 1, wherein the motor drive unit is adapted to determine whether power of the batteries in the battery compartment is below a minimum battery threshold and when determining that the battery power is below the minimum battery threshold to move the shade material to a battery replacement position.

18. The battery operated shade of claim 17, wherein the battery replacement position comprises a position where the bottom end of the shade material is positioned at a predetermined distance from the upper limit.

19. The battery operated shade of claim 17, wherein the minimum battery threshold corresponds to the battery power required to raise the shade material from the lower limit to the battery replacement position.

20. The battery operated shade of claim 19, wherein after moving the shade material to the battery replacement position, the motor drive unit disables movement of the shade material until the batteries are replaced.

* * * * *